United States Patent [19]

Takeuchi et al.

[11] 4,438,803

[45] Mar. 27, 1984

[54] CONTINUOUS CASTING OF STEEL SLABS AND BLOOMS FREE FROM SURFACE DEFECTS

[75] Inventors: Hidemaro Takeuchi; Shogo Matsumura; Ryoichi Hidaka; Yasunobu Ikehara, all of Yamaguchi; Tsuyoshi Saeki, Fukuoka, all of Japan

[73] Assignee: Nippon Steel Corporation, Tokyo, Japan

[21] Appl. No.: 249,982

[22] Filed: Apr. 1, 1981

[30] Foreign Application Priority Data

Apr. 4, 1980 [JP] Japan ..... 55-43628
Feb. 3, 1981 [JP] Japan ..... 56-14647

[51] Int. Cl.[3] ..... B22D 11/04; B22D 11/07
[52] U.S. Cl. ..... 164/472; 164/478
[58] Field of Search ..... 164/472, 478, 268, 416

[56] References Cited

U.S. PATENT DOCUMENTS 3,293,707 12/1966 Olsson ..... 164/478
3,708,314 1/1973 Kishida et al. ..... 164/472 X

FOREIGN PATENT DOCUMENTS 50-28896 9/1975 Japan ..... 164/478
604619 4/1978 U.S.S.R. ..... 164/416

*Primary Examiner*—Kuang Y. Lin
*Attorney, Agent, or Firm*—Cushman, Darby & Cushman

[57] ABSTRACT

Process for continuous casting of a steel slab free from surface defects, which comprises oscillating a mold under an oscillation condition which restricts the deformation of a meniscus portion of a strand shell so as to prevent oscillation defects.

5 Claims, 8 Drawing Figures

CONTINUOUS CASTING OF STEEL SLABS AND BLOOMS FREE FROM SURFACE DEFECTS

BACKGROUND OF THE INVENTION

Field of the Invention

The present invention relates to a process for producing continuously cast steel slabs and blooms free from surface defects and requiring substantially no surface conditioning.

In continuous casting, it is very important to reduce the friction between the mold wall and the solidified shell of the strand, so as to prevent the shell from sticking to the mold wall, and thereby prevent "break out." For these purposes, the so-called oscillation mold which oscillates up and down has been used to reduce the friction between the mold wall and the strand shell.

In conventional oscillation mold casting processes, an oscillating mold which oscillates in sine-curved strokes and which is of simplest mechanical structure, as disclosed in "Tekko Binran II" (Handbook of Iron and Steel), third edition, page 638, published by Japan Iron and Steel Association has been most widely used, and the oscillation is such that the maximum speed of the downward motion of the mold becomes higher than a given withdrawal speed of the strand. Thus as shown in FIG. 2, the withdrawal speed (mm/min.) of the strand is maintained constant, while the oscillation rate W(mm/min.) of the mold is $W=\pi \cdot S \cdot f \sin(2\pi \cdot f \cdot t)$ in which S represents the oscillation stroke (mm), and f represents the oscillation cycle (c/min.), and t represents the time (min.). The oscillation is in a sine curve, and the maximum speed of the downward movement $\pi \cdot S \cdot f$ is larger than the strand withdrawal speed V.

Supposing the time during which the mold moves downward is "$t_p$," and the time (healing time) during which the downward movement speed of the mold is larger than the withdrawal speed of the strand is "$t_h$," it is usually designed that the ratio of "$t_h$" to "$t_p$" (the ratio is usually called "negative strip") is maintained in the range of from 60 to 80%.

Most commonly adapted oscillation conditions are: oscillation cycle: 60–90 c/min.; oscillation stroke: 6–10 mm.

In conventional continuous casting using a sine-curve oscillation mold, it has been considered to be a key point, for the prevention of break outs, to maintain the healing time in a certain range so that friction between the mold wall and strand shell is reduced. For maintaining the healing time in a certain range, the three factors, the negative strip, the oscillation cycle, and the oscillation stroke must be adjusted other than the strand withdrawal speed which is maintained constant during the casting operation. In this connection, a higher oscillation cycle has been conventionally considered to be advantageous for consistent supply of powdered additives in between the mold wall and the strand shell. However, an excessively high oscillation cycle, a negative strip as high as 100% is required. Therefore, in the conventional art, 60–90 C/min. of oscillation cycle has been commonly used, and the other two factors, the negative strip and the oscillation stroke have been decided as hereinbefore with the oscillation cycle being maintained in the range of from 60 to 90 C/min.

However, it has been revealed that when continuous casting is done under the above conditions, shallow horizontal depression marks, widely known as "oscillation marks" are formed on the strand shell corresponding to each mold oscillation cycle. The oscillation marks are inevitably formed when an oscillation mold is used, and surface defects, such as abnormal structure due to segregation of the nickel content, fine cracks and entrappment of powdered mold additives, are very often caused along the depressed portion of the oscillation marks. These surface defects will be called hereinbelow "oscillation defects."

The mechanism of the occurrence of oscillation defects may be explained as below by reference to FIGS. 1 (*a*), (*b*) and (*c*).

In continuous casting with use of an oscillating mold, it is commonly practised to add powdered additives (herein called "powder") in the mold so as to provide lubricity between the mold wall and the strand shell, and the powder added within the mold is cooled on the strand shell and sticks thereto to form "slag bear." This slag bear tends to depress and deform the meniscus portion of the shell when the downward movement speed of the mold gets larger than the withdrawal speed of the strand during the downward movement of the mold, and when the mold turns to move upward and the meniscus portion of the shell departs from the slag bear, the molten steel flows onto the upper surface of the meniscus portion of the shell and solidifies there with spacing between the mold wall, resulting in formation of oscillation marks. The fine cracks which occur in the depressed portions oscillation marks are considered to be caused when the meniscus portion of the shell is deformed by the slag bear, while the abnormal structure enriched in segregated nickel, and the entrappment of the powder are considered to be caused by the molten steel and the powder flowing onto the upper portion of the meniscus which is deformed when the mold moves upward.

The oscillation defects in the portions of the resultant steel slabs corresponding to the depressed portions of the oscillation marks are seen mostly within the 2 mm depth of the surface of the steel slabs, and these defects appear as pickled surface irregularities and slivers when, for example, stainless steel slabs are directly rolled without surface conditionings, thus considerably degrading the surface quality of resultant steel sheet products. Therefore, conventionally these oscillation defects are removed by grinding at the intermediate step, but the required surface conditionings result in considerable additional production cost and lowered production yield, etc.

It has been further revealed through afterward experiments by the present inventors that additional defects occur when steel slabs free from the oscillation defects are rolled directly without surface conditionings, and it is impossible to assure complete freedom from surface conditionings. Thus, new additional surface defects, such as entrappments surface roughening and depressions, which occur irrespective to the oscillation marks, have been revealed. These defects are old ones which were confronted within the conventional processes, but raised no problem because they were removed during the whole surface grinding required for removing the oscillation marks.

Therefore, even when whole surface grinding is not necessary by eliminating oscillation defects, partial grinding is necessary for removing the additional surface defects in the case where additional surface defects exist.

The present inventors have discovered that these additional defects are caused by the powdered additives.

SUMMARY OF THE INVENTION

Therefore, one of the objects of the present invention is to provide a process for continuous casting of steel slabs and blooms free from the oscillation defects and the surface defects due to the powdered additives.

The other object of the present invention is to provide continuously cast steel slabs and blooms which require no surface conditionings for subsequent rolling.

The process according to the present invention comprises adjusting the oscillation conditions so as to prevent the deformation of the meniscus portion of the strand shell, preferably as set forth below and preferably using powded additives having a viscosity not larger than 1.5 poise at 1300° C.:

$V/S \cdot f < \pi$, $f \geqq 110$, $3 \leqq S \leqq 10$ or $V/S \cdot f \geqq \pi$ V: withdrawal speed of strand (mm/min.)

f: oscillation cycle (C/min.)

S: oscillation stroke (mm)

$\pi$: the circular constant

DETAILED DESCRIPTION OF THE INVENTION

The present invention will be described in detail hereinbelow with reference to the attached drawings.

The oscillation mold used in the present invention may be one as conventionally used and oscillation by means of conventional eccentric cams.

The powdered additives used in the present invention may be ones as conventionally used and have chemical compositions and physical properties as set forth in Table 1 below.

TABLE 1

| C | CaO | $SiO_2$ | $Al_2O_3$ | $Na^+$ | F | CaO/ $SiO_2$ | m.p. °C. | Viscosity $\eta$ at 1300° C. poise |
|---|---|---|---|---|---|---|---|---|
| <0.3 | 41.2 | 34.3 | 3.0 | 10.1 | 7.4 | 1.20 | 1015 | 1.3 |
| <0.3 | 41.1 | 32.5 | 2.8 | 10.2 | 7.8 | 1.26 | 1010 | 1.0 |
| <0.3 | 42.4 | 32.0 | 2.7 | 10.7 | 8.2 | 1.32 | 1000 | 0.7 |

The powdered additives are added onto the upper surface of a molten steel in the mold so as to cover and protect the molten steel from the atmosphere as conventionally done.

Detailed description will be made in connection with the cases where SUS 304 stainless steel slabs are continuously cast under the conditions shown in Table 2.

TABLE 2

| No. | Steels | Withdrawal Speed of Strand V(mm/min) | Oscillation Cycle f(C/min) | Oscillation Stroke S(mm) | V/S · f | Remarks |
|---|---|---|---|---|---|---|
| 1 | SUS304 | 1100 | 80 | 6 | 2.3 | Conventional Process |
| 2 | SUS304 | 1100 | 100 | 6 | 1.8 | Conventional Process |
| 3 | SUS304 | 1100 | 150 | 6 | 1.2 | Present Invention |
| 4 | SUS304 | 1100 | 200 | 6 | 0.9 | |
| 5 | SUS304 | 1100 | 250 | 6 | 0.7 | $\frac{V}{S \cdot f} < \pi$ |
| 6 | SUS304 | 1100 | 50 | 4 | 5.5 | Present Invention |
| 7 | SUS304 | 1100 | 80 | 4 | 3.4 | $\frac{V}{S \cdot f} \geqq \pi$ |

Figure 1A:
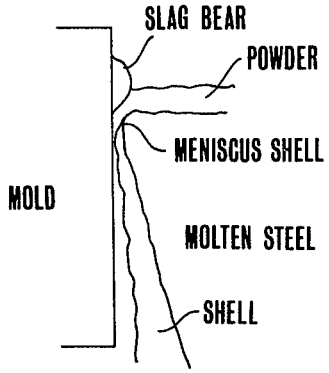
FIGS. 1(*a*), (*b*) and (*c*) show sequences of the mechanism of oscillation mark formation in the conventional process.
Figure 1B:
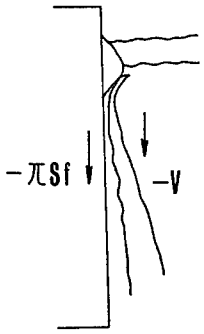
Figure 1C:
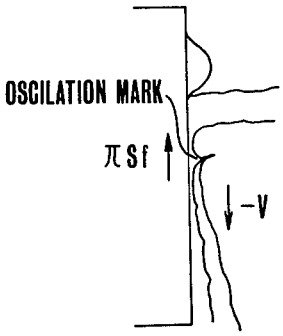
Figure 2:
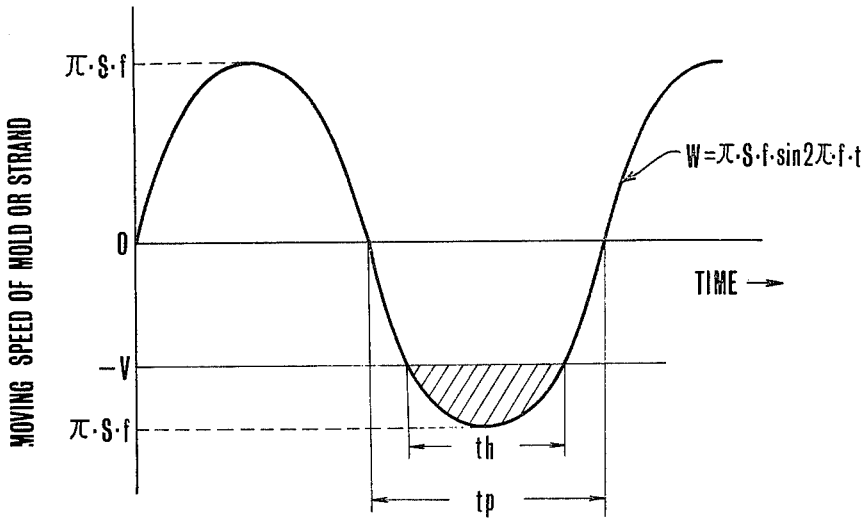
FIG. 2 shows the relation between the movement speed of the mold and the strand withdrawal speed and time.
Figure 3:
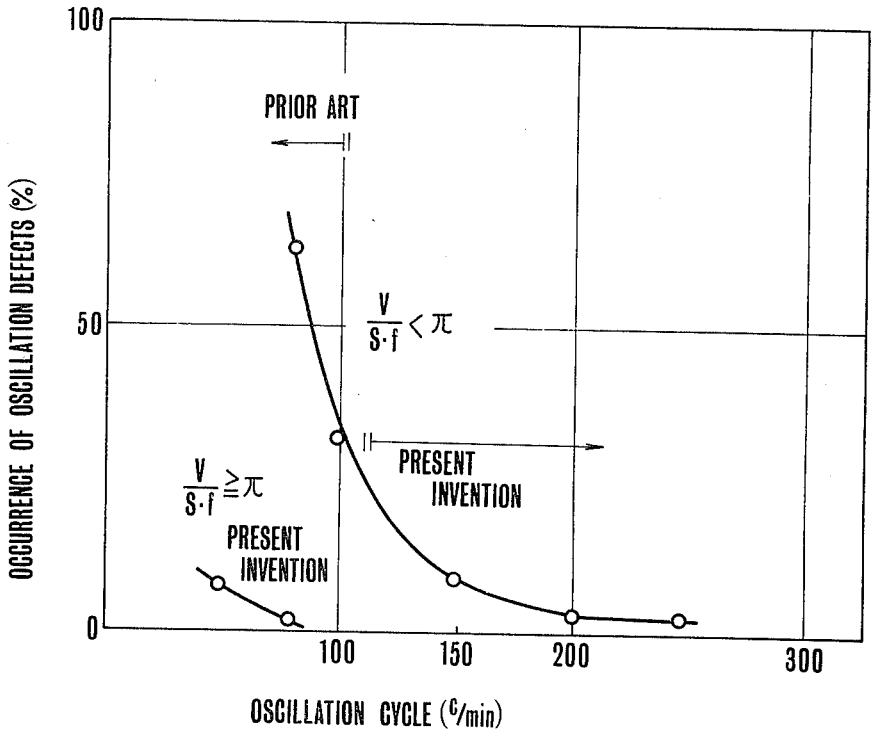
FIG. 3 shows the influence of oscillation cycles on the occurrence of oscillation defects.

The influence of the oscillation cycles on the occurrence of the oscillation defects is shown in FIG. 3.

The occurrence of the oscillation defects can be classified into two patterns: one appears when the maximum downward movement speed of the mold is larger than the withdrawal speed of the strand, and the other appears when the maximum downward speed is less than the withdrawal speed; that is, the zone in which the maximum downward movement speed $\pi S \cdot f$ is larger than the strand drawing speed V ($V/S \cdot f < \pi$) and the zone in which $\pi \cdot S \cdot f$ is less than V ($V/S \cdot f \geqq \pi$). In either case, the occurrence ratio of oscillation defects is lower as the oscillation cycle increases.

In the zone where the maximum downward movement speed ($\pi \cdot S \cdot f$) of the mold is larger than the withdrawal speed V of the strand, thus $V/S \cdot f < \pi$, the occurrence ratio of oscillation defects increases as the cycle f decreases particularly when it is at 110 cycles/min. or higher. Generally, the healing time $t_h$ becomes shorter as the cycle f increases.

The oscillation conditions according to the present invention have been determined so as to shorter the healing time $t_h$ by increasig the oscillation cycle to 110 C/min. or higher within the condition of $V/S \cdot f < \pi$, namely when the maximum downward movement speed $\pi \cdot S \cdot f$ of the mold is larger than the withdrawal speed V of the strand, and hence to shorten the time during which the slag bear depresses the meniscus, thus preventing the occurrence of oscillation defects. For this purpose, the casting must be performed with the oscillation stroke S not less than 3 mm but not larger than 10 mm within the range which satisfies the condition of $S > V/\pi \cdot f$. When the oscillation stroke S is less than 3 mm, the power added in the mold does not satisfactorily flow in between the mold wall and the strand shell, thus failing to prevent the sticking between the mold and the strand which leads to dangerous break outs.

On the other hand, when the oscillation stroke S is beyond 10 mm, the slag bear sticking to the mold wall depresses the meniscus together with the molten powder, so that the occurrence ratio of oscillation defects sharply increases.

Figure 4:
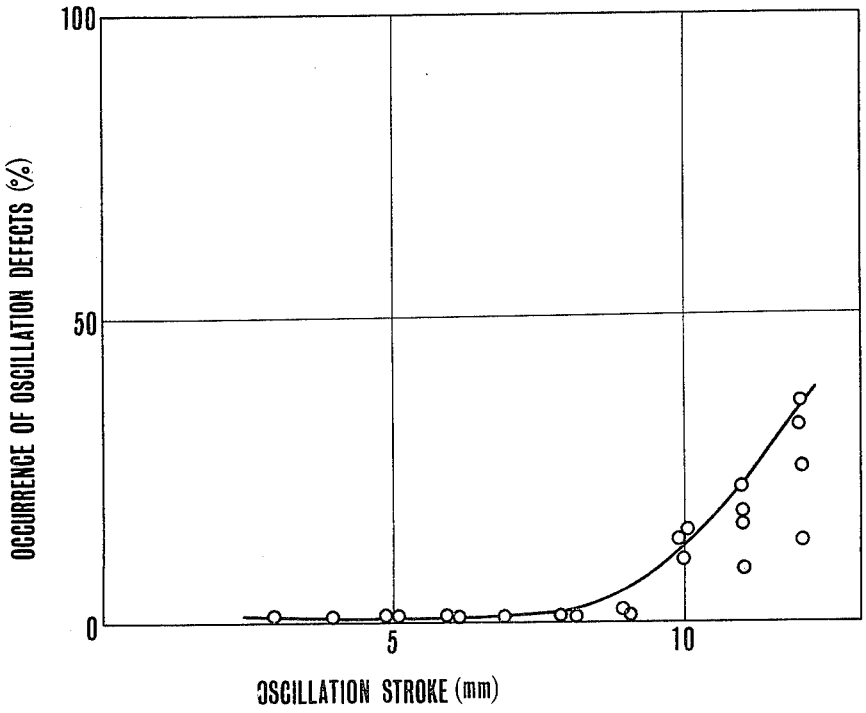
FIG. 4 shows the influence of oscillation strokes on the occurrence of oscillation defects.

The influence of the oscillation strokes at an oscillation cycle of 200 C/min. on the occurrence ratio of oscillation defects is shown in FIG. 4.

Figure 5:
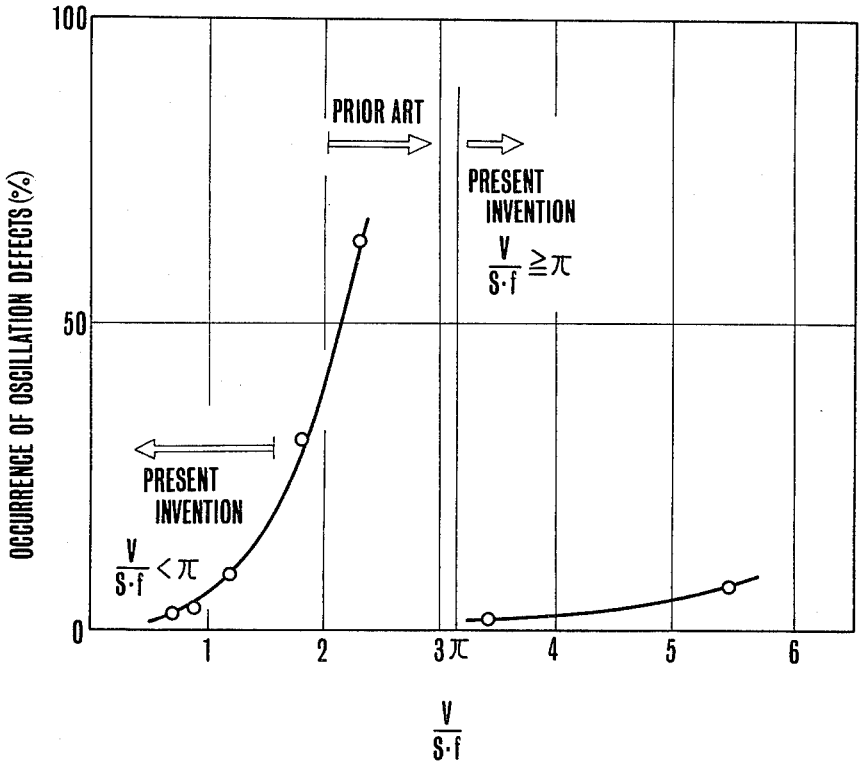
FIG. 5 shows the influence of V/S·f on the occurrence of oscillation defects.

The relation between the occurrence ratio of oscillation marks and the oscillation conditions in the zone where the maximum downward movement speed $\pi \cdot S \cdot f$ of the mold is less than the withdrawal speed V of the strand, thus $V/S \cdot f \geqq \pi$, will be described with reference to FIG. 5.

It is seen that substantially no oscillation defects are caused within the zone where the maximum downward movement speed $\pi \cdot S \cdot f$ of the mold is less than the withdrawal speed V of the strand, thus $V/s \cdot f \geqq \pi$. In this way, the slag bear is prevented from depressing the meniscus portion of the strand shell by maintaining the maximum downward movement speed $\pi \cdot S \cdot f$ of the mold less than the withdrawal speed V of the strand, and hence the meniscus portion is protected from being deformed, thus preventing the occurrence of oscillation defects. In this case, it is necessary to satisfy the condition of $V/S \cdot f \geqq \pi$, and since the withdrawal speed V of the strand is restricted by the cross sectional dimensions of the slab and the length of the cooling zone, the oscillation cycle f and the oscillation stroke S must be selected so as to satisfy the condition of $S \cdot f \leqq V/\pi$.

A larger oscillation cycle f is desirable for reducing the oscillation defects, but when the cycle f is increased, it is necessary to shorten the oscillation stroke S.

When the oscillation stroke S is reduced, the powdered additives are prevented from flowing in between the mold wall and the strand. Therefore, it is desirable to maintain the oscillation stroke S not less than 3 mm. When the oscillation stroke S is reduced, the amount of the powdered additives which flow in between the mold wall and the strand is also reduced, but the flow of the powdered additives therebetween can be promoted by lowering the viscosity of the powdered additives.

In the zone where the maximum downward movement speed of the mold is larger than the withdrawal speed of the strand, namely $V/S \cdot f < \pi$, the oscillation defects may be considerably reduced with an oscillation cycle of 110 C/min. or larger. However, if the oscillation cycle is at such a high level, the healing time $t_h$ is shortened so that the supply of the powdered additives in between the mold wall and the strand becomes insufficient and irregular and thus the additional defects such as surface roughening or intermittent depressions along the oscillation marks occur more readily. Also the downward movement speed of the mold increases as the oscillation cycle is increased to a high level, so that the slag bear formed by the solidification of molten powdered additives on the mold wall moves downward sticking to the mold wall and tends to cause additional defects such as entrapment of large particles of the additives.

In order to increase the flow rate and assure a uniform flow of the powdered additives in between the mold wall and the strand, it is necessary to lower the viscosity of the powdered additives. When the viscosity is increased, the supply shortage and flow irregularity of the powdered additives are promoted further, thus causing larger surface defects.

Figure 6:
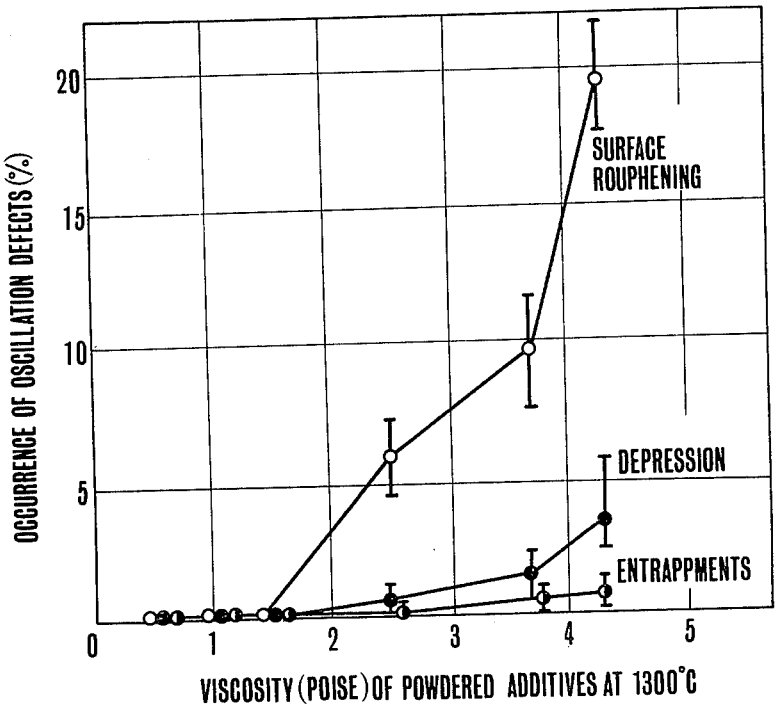
FIG. 6 shows the influences of the viscosity of powdered additives on the occurrence of slab surface defects.

The influence of the viscosity of the powdered additives at 1300° C. on the occurrence ratio of the slab surface defects is shown in FIG. 6. All of defects including the additional defects such as entrapment, open surface and depressions are reduced by lowering the viscosity of the powdered additives, and it has been found the viscosity of the powdered additives at 1300° C. must be not higher than 1.5 poise in order to prevent the additional defects.

When the oscillation cycle is maintained at a high level not lower than 110 C/min. and viscosity of the powdered additives at 1300° C. is adjusted to be 0.8 poise, the shape of oscillation marks formed on the resultant steel slabs has a deeper depth and width as compared with that of oscillation marks formed on steel slabs obtained by using a high oscillation cycle and a high viscosity of powdered additives, but they are almost equal with respect to the ratio of the depth to the width of the oscillation marks.

It has been also found that the oscillation defects, such as the nickel-rich abnormal structure, fine cracks and powder entrapments, which appear in the depressed portions of the oscillation marks can be further reduced by lowering the viscosity of the powdered additives.

In the zone where the withdrawal speed V of the strand is larger than the maximum downward movement speed $\pi \cdot S \cdot f$ of the mold, namely $V/S \cdot f \geqq \pi$, the friction between the mold wall and the strand shell is larger than that of the foregoing case so that the reduction of the friction by lubricity given by the powdered additive is more important.

In order to maintain the maximum downward movement speed $\pi \cdot S \cdot f$ of the mold less than the withdrawal speed V of the strand, it is necessary to reduce the oscillation cycle f or stroke S. However, if the cycle f or the stroke S is reduced, the supply of powdered additives in between the mold wall and the strand shell becomes insufficient and the flow itself becomes irregular so that the additional defects such as entrapments, surface roughening and depressions are readily caused. A lowered viscosity of powdered additives can increase the flow rate in between the mold wall and the strand shell, and reduce the friction therebetween, by the lubricity provided by the powdered additives, thus preventing the additional defects. In order to effectively prevent the surface defects, the viscosity of powdered additives at 1300° C. is usually 1.5 or lower.

The viscosity of the powdered additives can be adjusted by controlling the ratio of $SiO_2$ to CaO which are main components of the powdered additives. It is desirable to maintain the melting point of the powdered additives not higher than 1150° C., because if the melting point is higher than 1150° C., the powdered additives in incomplete fusion blow in between the mold wall and the strand shell, thus causing the additional defects in resultant steel slabs.

DESCRIPTION OF PREFERRED EMBODIMENTS

The present invention will be better understood from the following description of embodiments of the present invention with reference to Table 3.

SUS 304 and SUS 430 stainless steel slabs of 130 mm in thickness and 1000 mm in width are continuously cast under the conditions shown in Table 3 with use of different viscosities of powdered additives at 1300° C. at a strand withdrawal speed of 1100 mm/min.

When the value of $V/S \cdot f$ is smaller than $\pi$ and the oscillation cycle is 200 cpm or when the value of $V/S \cdot f$ is larger than $\pi$, the oscillation defects decrease and when a low-viscosity powder is used the additional defects decrease. The resultant steel slabs without surface conditioning are directly hot rolled, and cold rolled into steel sheets of 1.0 mm in thickness.

The steel sheets produced from the steel slabs continuously cast by prior arts suffer from many of acid-pickling irregulalities and slivers and shows an average production yield of 64%, while the steel sheets produced from the steel slabs according to the present invention show much less surface defect and an average production yield of 93% or higher.

TABLE 3

| Test Conditions | | | | | | Test Results | | | | |
|---|---|---|---|---|---|---|---|---|---|---|
| | | | | | | Additional | | | | |
| Steel Grade | Viscosity of Powder (at 1300° C.) | Oscillation Cycle f (C/min) | Oscillation Stroke S (mm) | Withdrawing Speed V (mm/min) | V/S · f | Oscillation Defect (%) | Defect of Steel Slab (%) | Method of Surface Conditioning of Steel Slab | Yield of Steel Sheet (%) | Evaluation |
| | | | | | Present Invention | | | | | |
| SUS304 | 0.6 | 50 | 4 | 1100 | 5.5 | 22.3 | 0.1 | completely no | 97 | Completely free from surface conditioning |
| SUS304 | 1.4 | 50 | 4 | 1100 | 5.5 | 2.8 | 0.1 | completely no | 96 | Completely free from surface conditioning |
| SUS430 | 1.2 | 50 | 4 | 1100 | 5.5 | 1.4 | 0.1 | completely no | 98 | Completely free from surface conditioning |
| SUS304 | 1.0 | 120 | 5 | 1100 | 1.8 | 22.2 | 0.1 | completely no | 93 | Completely free from surface conditioning |
| SUS304 | 1.0 | 130 | 5 | 1100 | 1.7 | 13.4 | 0 | completely no | 95 | Completely free from surface conditioning |
| SUS304 | 1.0 | 140 | 5 | 1100 | 1.6 | 9.8 | 0 | completely no | 96 | Completely free from surface conditioning |
| SUS304 | 0.6 | 200 | 6 | 1100 | 0.9 | 2.6 | 0.1 | completely no | 97 | Completely free from surface conditioning |
| SUS304 | 1.4 | 200 | 6 | 1100 | 0.9 | 2.8 | 0 | completely no | 98 | Completely free from surface conditioning |
| SUS430 | 1.2 | 200 | 6 | 1100 | 0.9 | 1.2 | 0.1 | completely no | 98 | Completely free from surface conditioning |
| SUS304 | 1.7 | 50 | 4 | 1100 | 5.5 | 4.5 | 8.2 | partial | 96 | only partial conditioning required |
| SUS304 | 1.7 | 200 | 6 | 1100 | 0.9 | 1.9 | 7.6 | partial | 98 | only partial conditioning required |
| | | | | | Comparison | | | | | |
| SUS304 | 1.7 | 90 | 5 | 1100 | 2.4 | 52.3 | 9.2 | partial | 71 | whole surface conditioning required |
| SUS304 | 1.7 | 100 | 5 | 1100 | 2.2 | 31.6 | 7.8 | partial | 83 | whole surface conditioning required |
| SUS304 | 2.2 | 80 | 6 | 1100 | 2.3 | 67.2 | 10.1 | partial | 64 | whole surface conditioning required |
| | | | | | Prior Art | | | | | |
| SUS304 | 2.2 | 80 | 6 | 1100 | 2.3 | 71.4 | 9.8 | whole surface was conditioned in 2 mm depth | 99 | — |

What is claimed is:

1. A process for continuous casting of a steel slab free from surface defects by oscillating a mold vertically with a sine-curved stroke, in which the maximum downward movement speed of the mold is larger than the strand withdrawal speed, and the mold is oscillated with an oscillation cycle not less than 110 C/min, and an oscillation stroke with a range of from 3 mm to 10 mm.

2. A process according to claim 1 in which powdered additive having a viscosity not higher than 1.5 poise at 1300° C. is used for the lubrication between the mold and the strand shell.

3. Process according to claim 1, in which the maximum downward movement speed of the mold is larger than the strand withdrawal speed, and the mole is oscillated with an oscillation cycle not less than 150 C/min., and an oscillation stroke within a range of from 3 mm to 10 mm.

4. Process according to claim 3, in which powdered additive having a viscosity not larger than 1.5 poise at 1300° C. is used for lubricity between the mold and the strand shell.

5. Process according to claims 3, 4, 1 or 2 in which the steel is a stainless steel.

* * * * *